US006564789B1

(12) United States Patent
Hu

(10) Patent No.: US 6,564,789 B1
(45) Date of Patent: May 20, 2003

(54) BB BULLET FEEDING DEVICE OF TOY GUN

(76) Inventor: Shih-Che Hu, 58, Ma Yuan West St., Taichung (TW)

( * ) Notice: Subject to any disclaimer, the term of this patent is extended or adjusted under 35 U.S.C. 154(b) by 14 days.

(21) Appl. No.: 10/012,154

(22) Filed: Nov. 29, 2001

(51) Int. Cl.[7] ..... F41B 11/00
(52) U.S. Cl. ..... 124/66
(58) Field of Search ..... 124/65, 66, 63, 124/72

(56) References Cited

U.S. PATENT DOCUMENTS

| | | | | | |
|---|---|---|---|---|---|
| 1,856,285 | A | * | 5/1932 | Lefever | 124/66 |
| 2,213,318 | A | * | 9/1940 | Lefever | 124/66 |
| 2,594,240 | A | * | 4/1952 | Wells | 124/76 |
| 3,855,989 | A | * | 12/1974 | Hand | 124/65 |
| 5,349,938 | A | * | 9/1994 | Farrell | 124/73 |
| 5,570,676 | A | * | 11/1996 | Gore | 124/56 |
| 5,680,853 | A | * | 10/1997 | Clayton | 124/66 |
| 6,371,099 | B1 | * | 4/2002 | Lee | 124/66 |

FOREIGN PATENT DOCUMENTS

| | | | | |
|---|---|---|---|---|
| FR | 2631557 A3 | * | 11/1989 | A63H/05/04 |
| GB | 2206810 A | * | 1/1989 | F41B/11/00 |

* cited by examiner

*Primary Examiner*—Peter M Poon
*Assistant Examiner*—Susan Piascik

(57) ABSTRACT

The present invention relates to a BB bullet feeding device of a toy gun, including a cylinder, a piston cylinder, a front spring guide tube, a piston spring, a rear spring guide tube, a nozzle, a sealing tube, a bullet feeding spring, and a trigger operation set. Thus, the piston cylinder may be moved in the cylinder horizontally, and the BB bullet may be rapidly and stably pushed to a predetermined position by the restoring force of the piston spring and the bullet feeding spring during the single rearward stroke of the piston cylinder.

18 Claims, 9 Drawing Sheets

BB BULLET FEEDING DEVICE OF TOY GUN

BACKGROUND OF THE INVENTION

1. Field of the Invention

The present invention relates to a BB bullet feeding device of a toy gun, and more particularly to a BB bullet feeding device of a toy gun, wherein the BB bullet may be fed and ejected outward in a pneumatic manner easily and exactly, without needing an electric power, thereby saving cost and natural resource, and thereby increasing the lifetime of the BB bullet feeding device.

2. Description of the Related Art

A conventional BB bullet feeding device of a toy gun in accordance with the prior art comprises a piston cylinder horizontally moved in a cylinder, thereby achieving the bullet feeding process of the BB bullet. The piston cylinder may act the air flow in the cylinder to push and eject the BB bullet outward. However, the conventional BB bullet feeding device uses an electric power as a power source, thereby increasing cost and consuming the natural resource, and thereby decreasing the lifetime of the BB bullet feeding device.

SUMMARY OF THE INVENTION

The present invention has arisen to mitigate and/or obviate the disadvantage of the conventional BB bullet feeding device of a toy gun.

The primary objective of the present invention is to provide a BB bullet feeding device of a toy gun, wherein the piston cylinder is moved in the cylinder horizontally, and the BB bullet may be rapidly and stably pushed to the predetermined position by the restoring force of the piston spring and the bullet feeding spring during the single rearward stroke of the piston cylinder.

An other objective of the present invention is to provide a BB bullet feeding device of a toy gun, wherein the BB bullet may be fed and ejected outward in a pneumatic manner easily and exactly, without needing an electric power, thereby saving cost and natural resource, and thereby increasing the lifetime of the BB bullet feeding device.

A further objective of the present invention is to provide a BB bullet feeding device of a toy gun, wherein the BB bullet feeding device may be assembled and dismantled easily and conveniently, thereby greatly facilitating maintenance of the BB bullet feeding device.

A further objective of the present invention is to provide a BB bullet feeding device of a toy gun, wherein the piston cylinder is received in the cylinder, and horizontal movement of the piston may feed the BB bullet automatically, thereby facilitating the user employing the BB bullet feeding device.

In accordance with the present invention, there is provided a BB bullet feeding device of a toy gun, horizontally mounted in a barrel of a gun body, and comprising:

a cylinder, a piston cylinder, a front spring guide tube, a piston spring, a rear spring guide tube, a nozzle, a sealing tube, a bullet feeding spring, and a trigger operation set, the gun body provided with a BB bullet supply portion at a front end of the barrel, and a cocking handle at an upper portion of the BB bullet supply portion to move horizontally, the BB bullet supply portion formed with a transverse hole which includes a mediate section provided with a bullet feeding chamber having a pressure applying portion, and a front section provided with a bullet outlet tube, wherein:

the cylinder is secured on a rear portion of the BB bullet supply portion;

the piston cylinder is movable in the cylinder, and has an inner portion formed with a receiving chamber, the piston cylinder has a front end received in the cylinder, and a rear end extended outward from a rear portion of the cylinder and formed with a piston push portion rested on a distal end of the cocking handle, the front end of the piston cylinder has an outer wall formed with a locking recess;

the front spring guide tube is secured in a front end of the receiving chamber of the piston cylinder to horizontally move with the piston cylinder simultaneously;

the piston spring has a front end mounted on an outer wall of the front spring guide tube;

the rear spring guide tube has a front end extended into a rear end of the chamber of the piston cylinder, and has a rear end secured to a distal end of the barrel, the rear spring guide tube has an inner portion including a front section formed with a spring receiving chamber and a rear section formed with a guide rod through hole;

the nozzle has a front section received in a rear section of the transverse hole of the BB bullet supply portion;

the sealing tube is formed with a receiving space, and has a front section extended through a center of the front spring guide tube and secured on the nozzle, the receiving space of the sealing tube has a mediate section formed with a through hole, a locking hook is pivoted in the receiving space of the sealing tube, and has an action portion protruded outward from the through hole, a guide rod is received in a rear section of the receiving space of the sealing tube, and has an extension section extended outward from a through hole formed in a rear end of the sealing tube, the extension section has a rear end received in the guide rod through hole of the rear spring guide tube;

the bullet feeding spring is mounted on an outer wall of the extension section of the sealing tube, and received in the spring receiving chamber of the rear spring guide tube;

the trigger operation set includes a trigger, a block push member, and a locking block, the locking block is detachably received in the locking recess of the piston cylinder.

Further benefits and advantages of the present invention will become apparent after a careful reading of the detailed description with appropriate reference to the accompanying drawings.

DETAILED DESCRIPTION OF THE INVENTION

Figure 1:
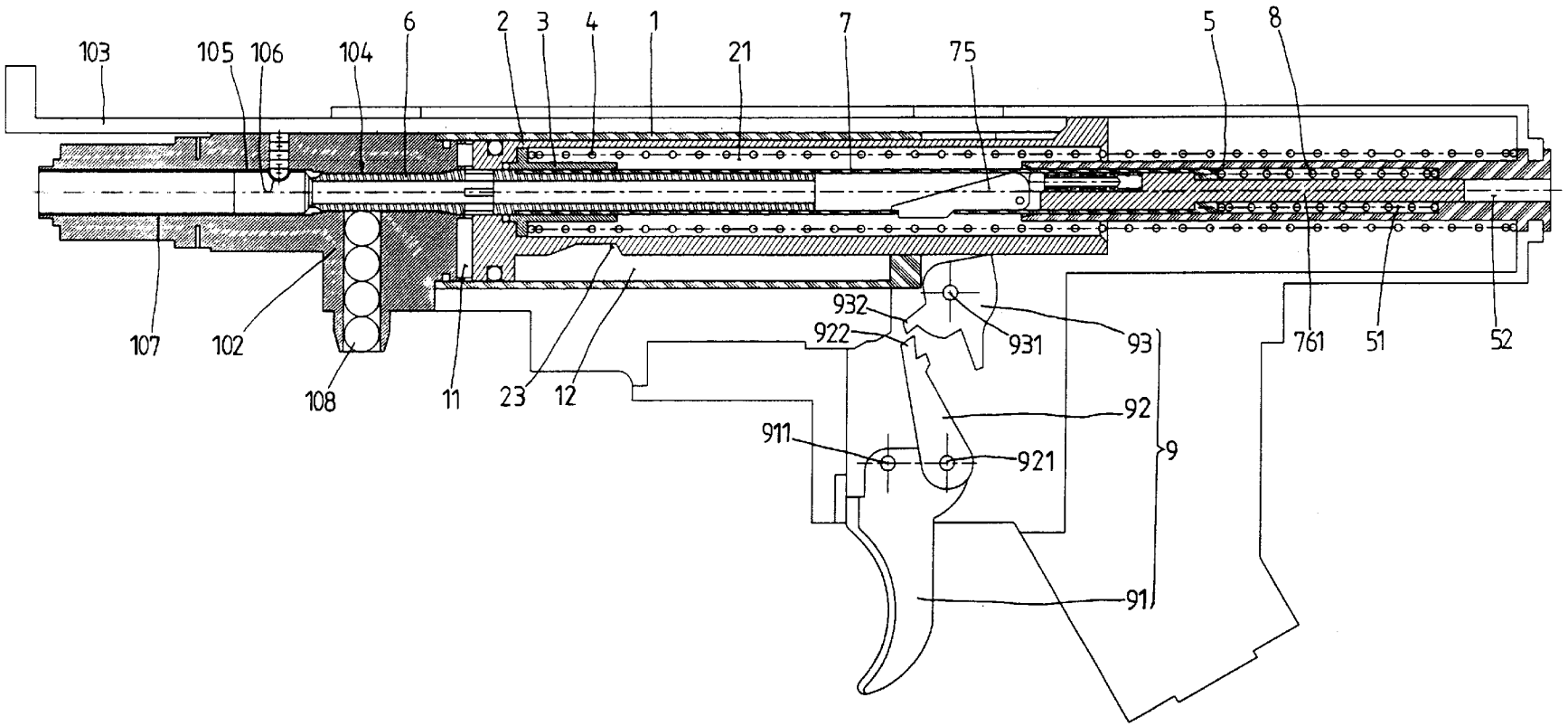
FIG. 1 is a front plan cross-sectional assembly view of a BB bullet feeding device of a toy gun in accordance with a first embodiment of the present invention.
Figure 2:
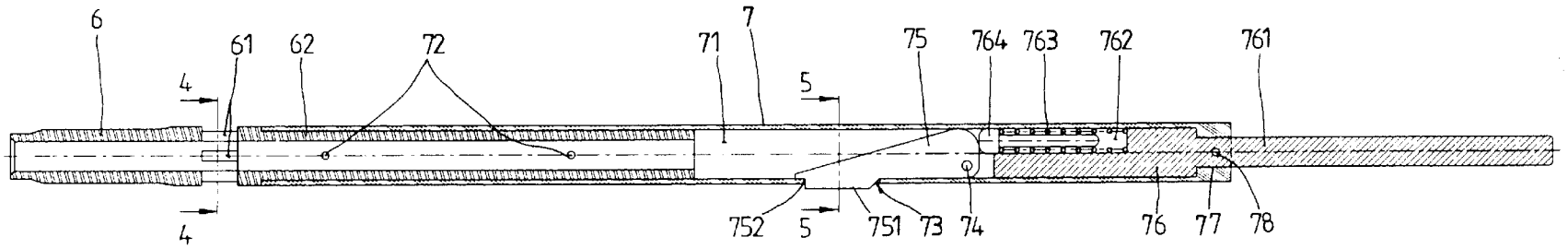
FIG. 2 is a front plan cross-sectional assembly view of a nozzle and a sealing tube of the BB bullet feeding device of a toy gun in accordance with the first embodiment of the present invention.
Figure 3:
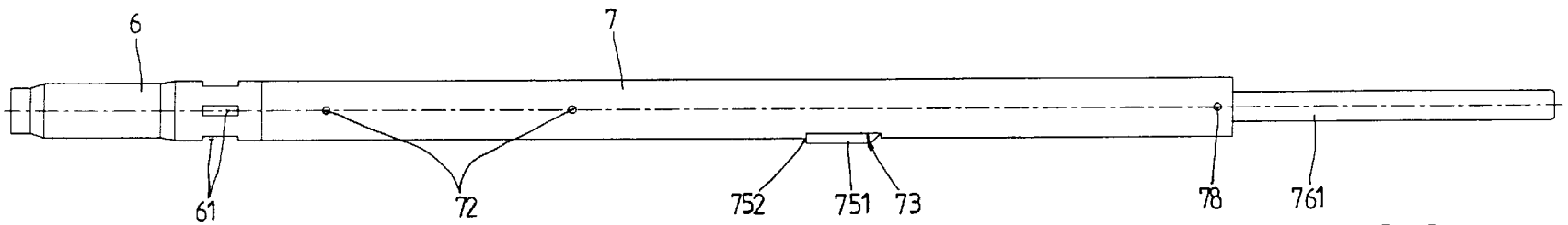
FIG. 3 is a plan view of the BB bullet feeding device of a toy gun as shown in FIG. 2.
Figure 4:
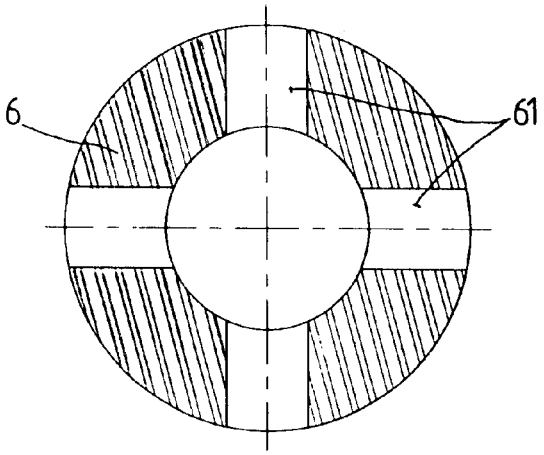
FIG. 4 is a cross-sectional view of the BB bullet feeding device of a toy gun taken along line 4—4 as shown in FIG. 2.
Figure 5:
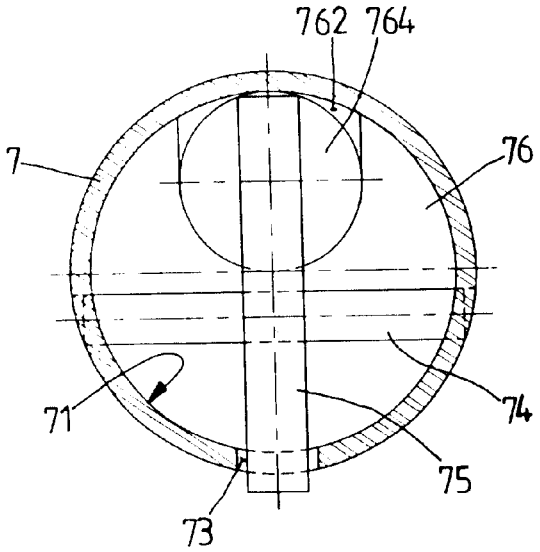
FIG. 5 is a cross-sectional view of the BB bullet feeding device of a toy gun taken along line 5—5 as shown in FIG. 2.

Referring to the drawings and initially to FIGS. 1–5, a BB bullet feeding device of a toy gun in accordance with a first embodiment of the present invention is horizontally mounted in a barrel 101 of a gun body 10, and comprises a cylinder 1, a piston cylinder 2, a front spring guide tube 3, a piston spring 4, a rear spring guide tube 5, a nozzle 6, a sealing tube 7, a bullet feeding spring 8, and a trigger operation set 9.

The gun body 10 is provided with a BB bullet supply portion 102 at a front end of the barrel 101, and a cocking handle 103 at an upper portion of the BB bullet supply portion 102 to move horizontally.

The cylinder 1 is secured on a rear portion of the BB bullet supply portion 102, and has an inner portion divided by a front section of the piston cylinder 2 into a left air chamber 11 and a right air chamber 12.

The piston cylinder 2 is movable in the cylinder 1, and has an inner portion formed with a U-shaped receiving chamber 21. The piston cylinder 2 has a front end received in the cylinder 1, and a rear end extended outward from a rear portion of the cylinder 1 and formed with a piston push portion 22 rested on a distal end of the cocking handle 103. The front end of the piston cylinder has an outer wall formed with a locking recess 23.

The front spring guide tube 3 is secured in a front end of the receiving chamber 21 of the piston cylinder 2, to horizontally move with the piston cylinder 2 simultaneously.

The piston spring 4 may be compressed and extended, and has a front end mounted on an outer wall of the front spring guide tube 3.

The rear spring guide tube 5 has a front end extended into a rear end of the receiving chamber 21 of the piston cylinder 2, and has a rear end secured to a distal end of the barrel 101. The piston spring 4 has a rear end mounted on an outer wall of the rear spring guide tube 5. The rear spring guide tube 5 has an inner portion including a front section formed with a spring receiving chamber 51 and a rear section formed with a guide rod through hole 52.

The nozzle 6 is a hollow cylinder, and has a front section received in a rear section of a transverse hole 104 of the BB bullet supply portion 102, a mediate section formed with multiple air collection ports 61, and a rear section formed with an insertion section 62. The transverse hole 104 of the BB bullet supply portion 102 includes a mediate section provided with a bullet feeding chamber 105 having a pressure applying portion 106, and a front section provided with a bullet outlet tube 107.

The sealing tube 7 is formed with a U-shaped receiving space 71, and has a front section extended through a center of the front spring guide tube 3 and secured on the insertion section 62 of the nozzle 6 by multiple positioning bolts 72. The receiving space 71 of the sealing tube 7 has a mediate section formed with a through hole 73. A locking hook 75 is pivoted in the receiving space 71 of the sealing tube 7 by a hook bolt 74, and has an action portion 751 protruded outward from the through hole 73 and formed with a locking opening 752. A T-shaped guide rod 76 is received in a rear section of the receiving space 71 of the sealing tube 7, and has an extension section 761 extended outward from a through hole 77 formed in a rear end of the sealing tube 7. The extension section 761 has a rear end received in the guide rod through hole 52 of the rear spring guide tube 5. The guide rod 76 is secured with the sealing tube 7 by a rod fixing bolt 78. The guide rod 76 has a front section formed with a spring receiving chamber 762 for receiving a hook push spring 763, and a hook push member 764 whose front end face is rested on a rear end face of the locking hook 75.

The bullet feeding spring 8 is mounted on an outer wall of the extension section 761 of the sealing tube 7, and received in the spring receiving chamber 51 of the rear spring guide tube 5.

The trigger operation set 9 includes a trigger 91, a block push member 92, and a locking block 93. The trigger 91 is pivoted on a mediate section of the barrel 101 of the gun body 10 by a trigger pivot axle 911. The block push member 92 has a lower end pivoted on the trigger 91 by a pivot axle 921, and an upper end provided with a push portion 922. The locking block 93 is pivoted on the barrel 101 of the gun body 10 by a pivot axle 931, and located above the block push member 92. The locking block 93 is provided with a driven portion 932 that may mate with the push portion 922 of the block push member 92.

In operation, referring to FIGS. 6–9 with reference to FIGS. 1–5, the cocking handle 103 may be pushed toward the rear portion of the barrel 101. The piston push portion 22 of the piston cylinder 2 is rested on the distal end of the cocking handle 103 so that the piston cylinder 2 may be moved rearward with the cocking handle 103 simultaneously, and the nozzle 6 and the sealing tube 7 may be moved rearward with the piston cylinder 2 simultaneously as shown FIG. 6. Thus, the front end of the nozzle 6 is detached from the top of the BB bullet supply portion 102, so that the BB bullet 108 may be pushed by an upward elastic force to enter the transverse hole 104.

Figure 6:
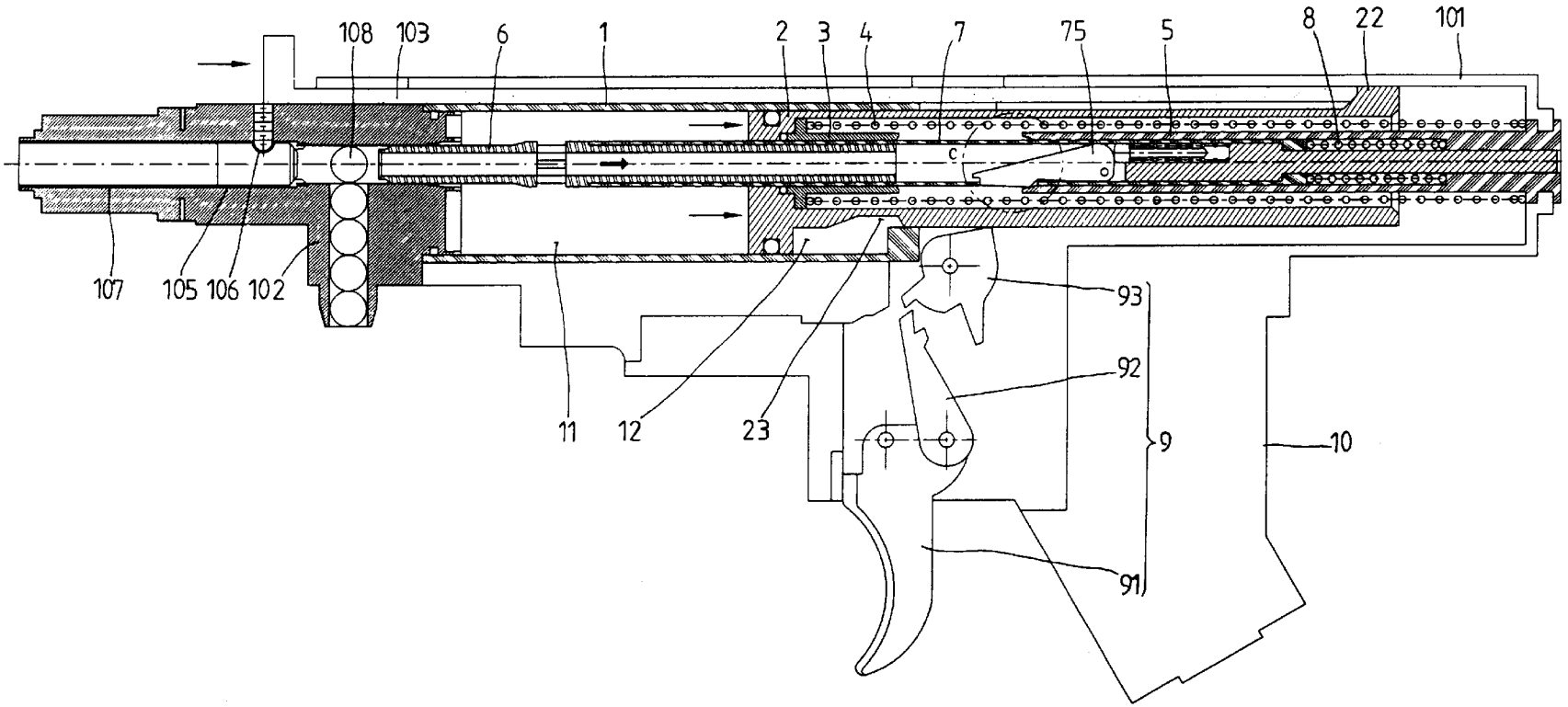
FIG. 6 is a schematic operational view of the BB bullet feeding device of a toy gun as shown in FIG. 1 in use.
Figure 6A:
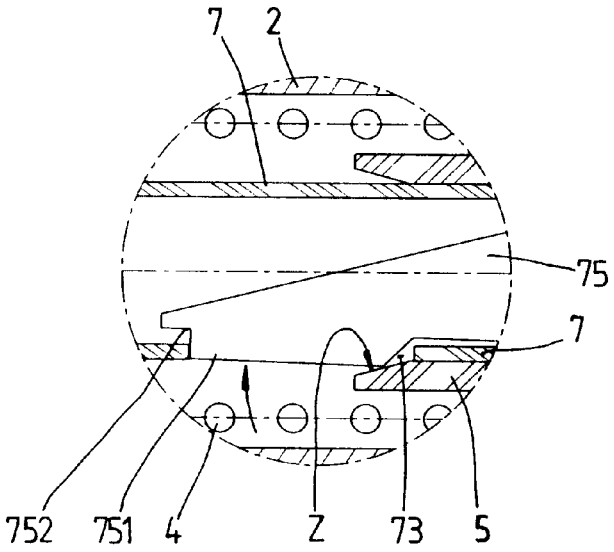
FIG. 6A is a partially cut-away enlarged view of the BB bullet feeding device of a toy gun as shown in FIG. 6.
Figure 7:
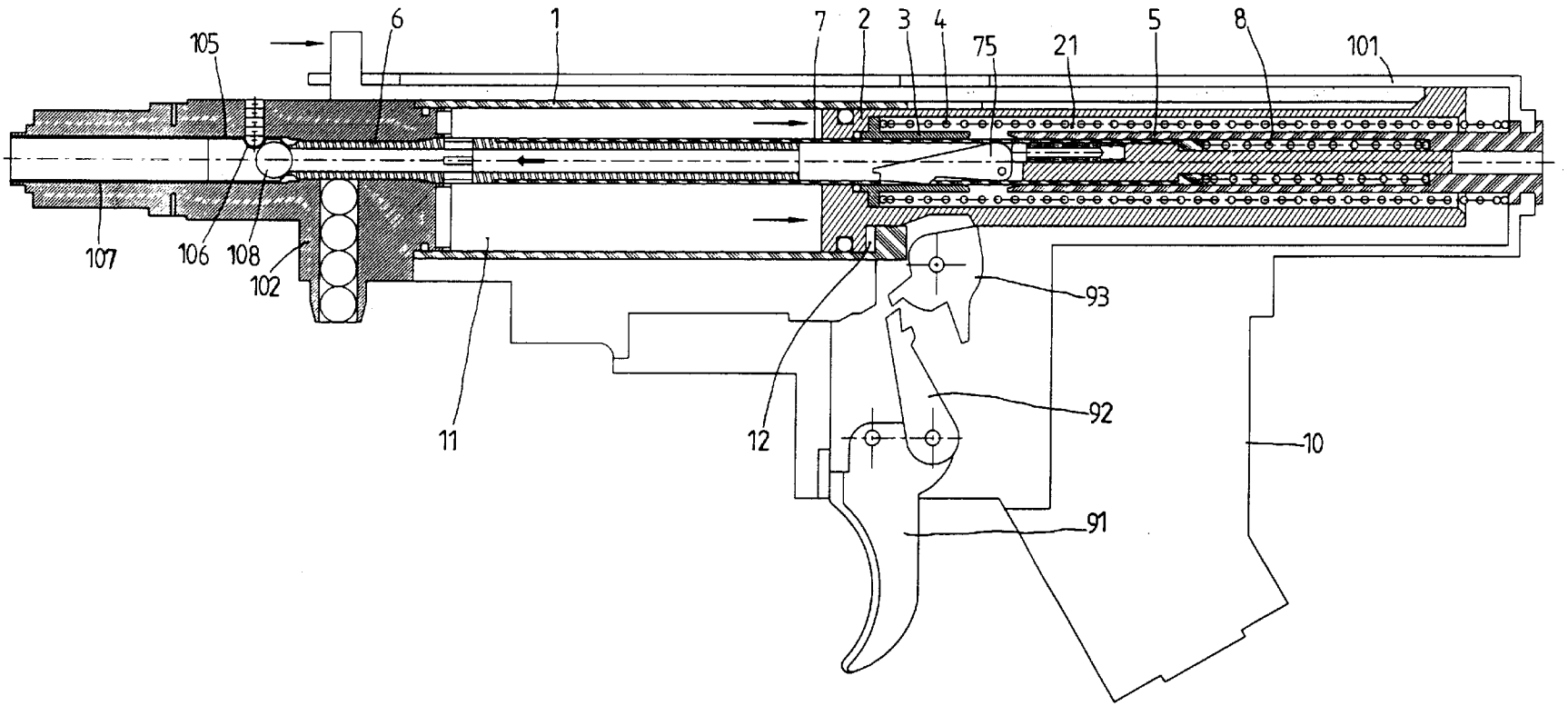
FIG. 7 is a schematic operational view of the BB bullet feeding device of a toy gun as shown in FIG. 6 in use.

As shown in FIG. 6A, when the sealing tube 71 is moved rearward, the locking hook 75 of the sealing tube 7 is lifted by an inclined face "Z" of the rear spring guide tube 5, whereby the locking opening 752 of the locking hook 75 may be detached from the through hole 73 of the sealing tube 7, so that the sealing tube 7 and the nozzle 6 may be pushed forward by the restoring force of the bullet feeding spring 8, to push the BB bullet 108 in the transverse hole 104 to reach the position of the pressure applying portion 106 of the bullet feeding chamber 105 as shown in FIG. 7.

Figure 8:
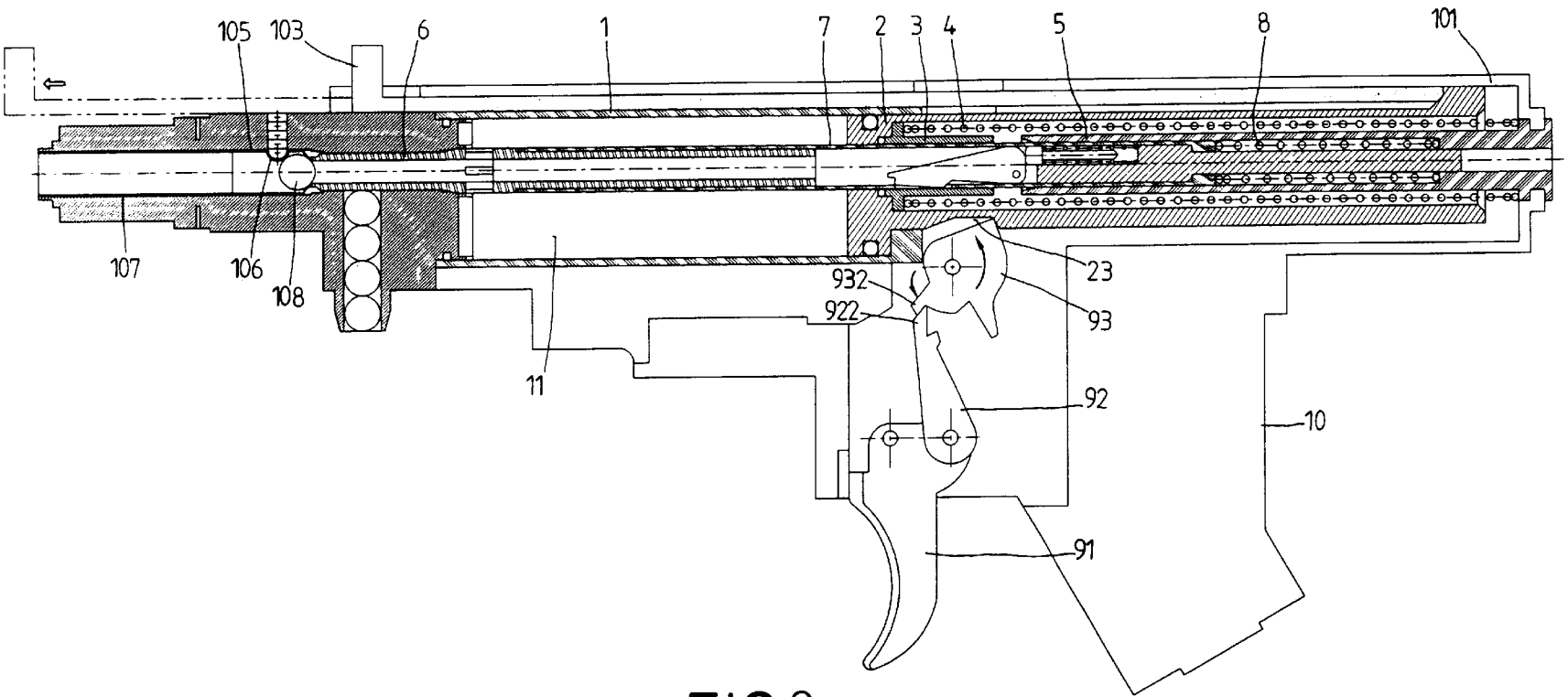
FIG. 8 is a schematic operational view of the BB bullet feeding device of a toy gun as shown in FIG. 7 in use.

During the stroke of the piston cylinder 2 pushed by the cocking handle 103, when the locking block 93 rotated counterclockwise enters the locking recess 23 of the piston cylinder 2, movement of the piston cylinder 2 is stopped as shown in FIG. 8, so that the driven portion 932 of the locking block 93 is engaged with the push portion 922 of the block push member 92.

Figure 9:
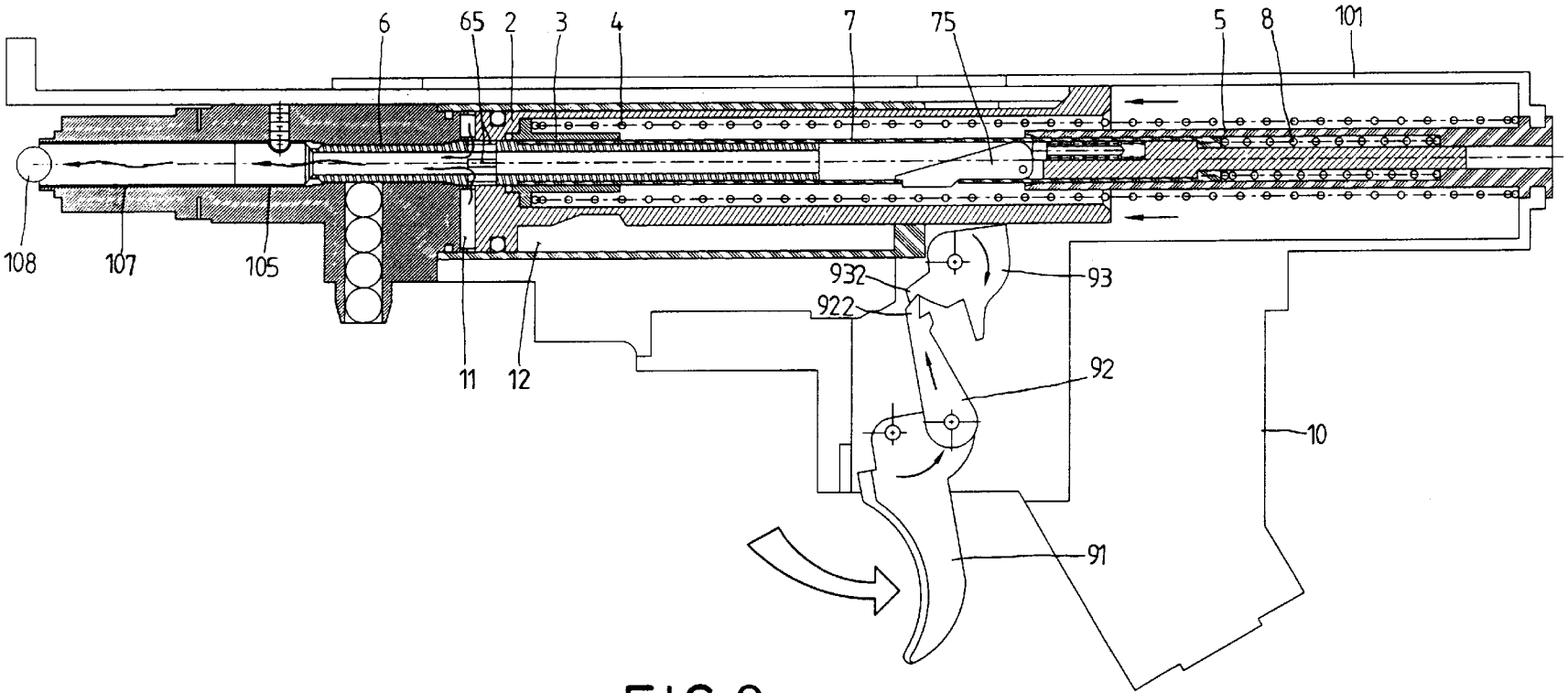
FIG. 9 is a schematic operational view of the BB bullet feeding device of a toy gun as shown in FIG. 8 in use.

Thus, when the trigger 91 is pressed as shown in FIG. 9, the trigger 91 may be pivoted counterclockwise, to pivot and move the block push member 92 upward, so that the push portion 922 of the block push member 92 may push the driven portion 932 of the locking block 93 upward, so as to pivot the locking block 93 clockwise, thereby detaching the locking block 93 from the locking recess 23 of the piston cylinder 2, so that the piston cylinder 2 may be pressed forward by the restoring force of the piston spring 4, to compress the air contained in the left chamber 11 of the cylinder 1, so that the compressed air may be forced through the air collection ports 61 of the nozzle 6 toward the bullet feeding chamber 105, so that the BB bullet 108 located at the pressure applying portion 106 may be ejected outward through the bullet outlet tube 107 as shown in FIG. 9.

Figure 11:
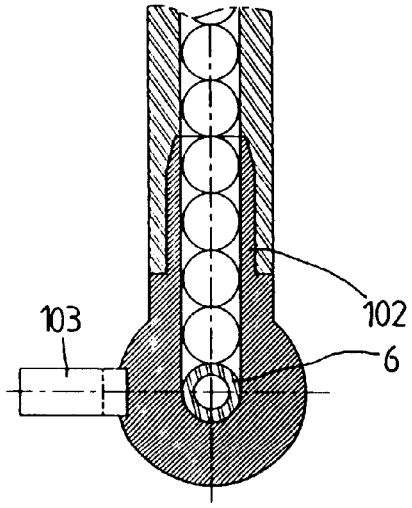
FIG. 11 is a cross-sectional view of the BB bullet feeding device of a toy gun taken along line 11—11 as shown in FIG. 10.
Figure 10:
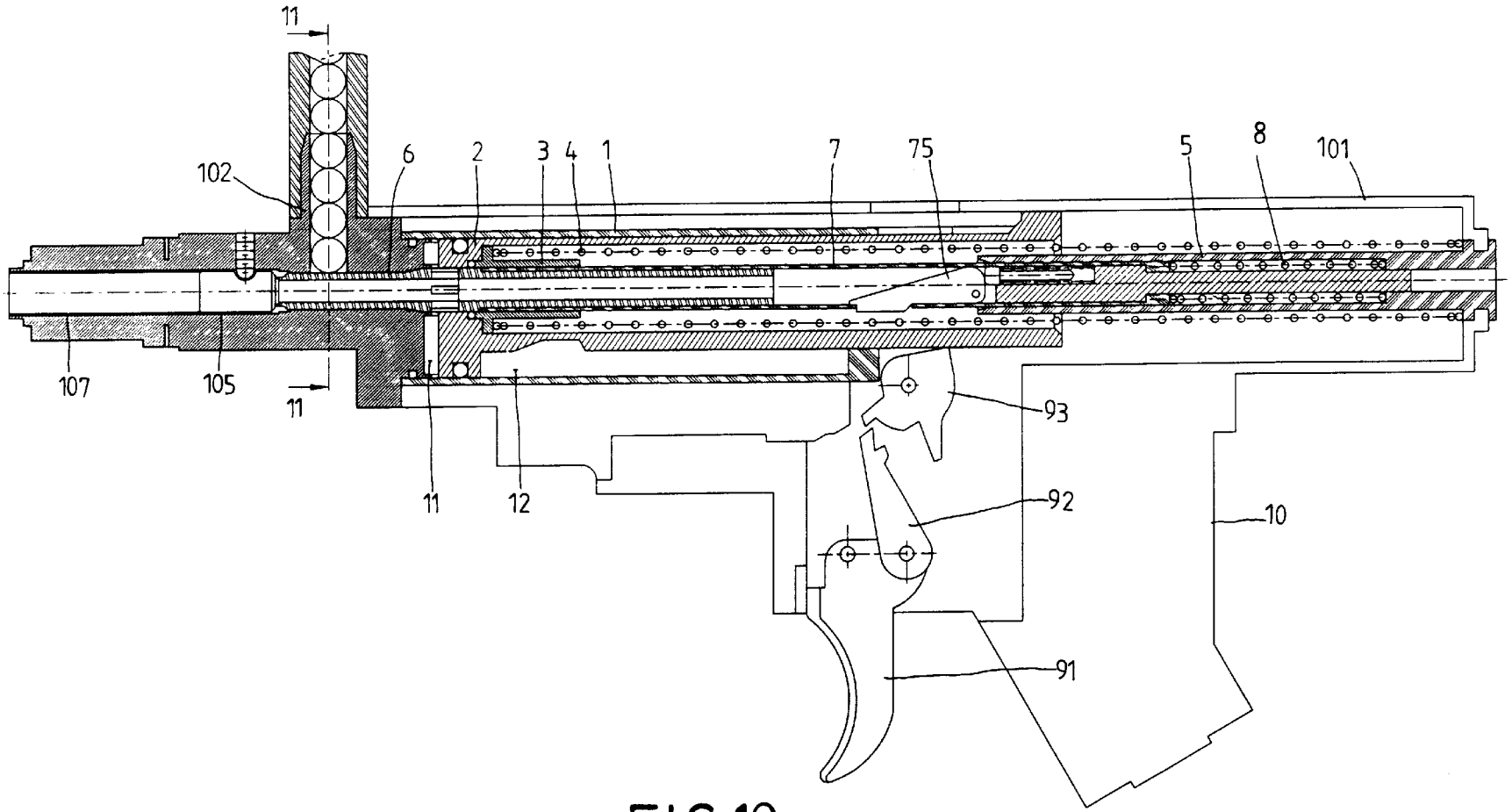
FIG. 10 is a front plan cross-sectional assembly view of a BB bullet feeding device of a toy gun in accordance with a second embodiment of the present invention.

Referring to FIGS. 10 and 11, the BB bullet supply portion 102 of the BB bullet feeding device of a toy gun in accordance with a second embodiment of the present invention is mounted on the top of the barrel 101, and the cocking handle 103 is mounted on a side of the BB bullet supply portion 102.

Accordingly, the BB bullet feeding device of a toy gun in accordance with the present invention has the following advantages.

1. The piston cylinder 2 is moved in the cylinder 1 horizontally, and the BB bullet 108 may be rapidly and stably pushed to the predetermined position by the restoring force of the piston spring 4 and the bullet feeding spring 8 during the single rearward stroke of the piston cylinder 2.

2. The BB bullet 108 of the BB bullet feeding device may be fed and triggered in a pneumatic manner easily and exactly, without needing an electric power, thereby saving cost and natural resource, and thereby increasing the lifetime of the BB bullet feeding device.

3. The BB bullet feeding device may be assembled and dismantled easily and conveniently, thereby greatly facilitating maintenance of the BB bullet feeding device.

4. The piston cylinder 2 is received in the cylinder 1, and horizontal movement of the piston 2 may feed the BB bullet 108 automatically, thereby facilitating the user employing the BB bullet feeding device.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A BB bullet feeding device of a toy gun, horizontally mounted in a barrel of a gun body, and comprising: a cylinder, a piston cylinder, a front spring guide tube, a piston spring, a rear spring guide tube, a nozzle, a sealing tube, a bullet feeding spring, and a trigger operation set, the gun body provided with a BB bullet supply portion at a front end of the barrel, and a cocking handle at an upper portion of the BB bullet supply portion to move horizontally, the BB bullet supply portion formed with a transverse hole which includes a mediate section provided with a bullet feeding chamber having a pressure applying portion, and a front section provided with a bullet outlet tube, wherein:

the cylinder is secured on a rear portion of the BB bullet supply portion;

the piston cylinder is movable in the cylinder, and has an inner portion formed with a receiving chamber, the piston cylinder has a front end received in the cylinder, and a rear end extended outward from a rear portion of the cylinder and formed with a piston push portion rested on a distal end of the cocking handle, the front end of the piston cylinder has an outer wall formed with a locking recess;

the front spring guide tube is secured in a front end of the receiving chamber of the piston cylinder to horizontally move with the piston cylinder simultaneously;

the piston spring has a front end mounted on an outer wall of the front spring guide tube;

the rear spring guide tube has a front end extended into a rear end of the receiving chamber of the piston cylinder, and has a rear end secured to a distal end of the barrel, the rear spring guide tube has an inner portion including a front section formed with a spring receiving chamber and a rear section formed with a guide rod through hole;

the nozzle has a front section received in a rear section of the transverse hole of the BB bullet supply portion;

the sealing tube is formed with a receiving space, and has a front section extended through a center of the front spring guide tube and secured on the nozzle, the receiving space of the sealing tube has a mediate section formed with a through hole, a locking hook is pivoted in the receiving space of the sealing tube, and has an action portion protruded outward from the through hole, a guide rod is received in a rear section of the receiving space of the sealing tube, and has an extension section extended outward from a through hole formed in a rear end of the sealing tube, the extension section has a rear end received in the guide rod through hole of the rear spring guide tube;

the bullet feeding spring is mounted on an outer wall of the extension section of the sealing tube, and received in the spring receiving chamber of the rear spring guide tube;

the trigger operation set includes a trigger, a block push member, and a locking block, the locking block is detachably received in the locking recess of the piston cylinder.

2. The BB bullet feeding device of a toy gun in accordance with claim 1, wherein the cylinder has an inner portion divided by a front section of the piston cylinder into a left air chamber and a right air chamber.

3. The BB bullet feeding device of a toy gun in accordance with claim 1, wherein the receiving chamber of the piston cylinder is U-shaped.

4. The BB bullet feeding device of a toy gun in accordance with claim 1, wherein the piston spring has a rear end mounted on an outer wall of the rear spring guide tube.

5. The BB bullet feeding device of a toy gun in accordance with claim 1, wherein the nozzle is a hollow cylinder.

6. The BB bullet feeding device of a toy gun in accordance with claim 1, wherein the nozzle has a mediate section formed with multiple air collection ports.

7. The BB bullet feeding device of a toy gun in accordance with claim 1, wherein the nozzle has a rear section formed with an insertion section, and the front section of the sealing tube is secured on the insertion section of the nozzle.

8. The BB bullet feeding device of a toy gun in accordance with claim 7, wherein the front section of the sealing tube is secured on the insertion section of the nozzle by multiple positioning bolts.

9. The BB bullet feeding device of a toy gun in accordance with claim 1, wherein the receiving space of the sealing tube is U-shaped.

10. The BB bullet feeding device of a toy gun in accordance with claim 1, wherein the locking hook is pivoted in the receiving space of the sealing tube by a hook bolt.

11. The BB bullet feeding device of a toy gun in accordance with claim 1, wherein the action portion of the locking hook is formed with a locking opening.

12. The BB bullet feeding device of a toy gun in accordance with claim 1, wherein the guide rod is T-shaped.

13. The BB bullet feeding device of a toy gun in accordance with claim 1, wherein the guide rod is secured with the sealing tube by a rod fixing bolt.

14. The BB bullet feeding device of a toy gun in accordance with claim 1, wherein the guide rod has a front section formed with a spring receiving chamber for receiving a hook push spring, and a hook push member, the hook push member has a front end face rested on a rear end face of the locking hook.

15. The BB bullet feeding device of a toy gun in accordance with claim 1, wherein the trigger is pivoted on a mediate section of the barrel of the gun body by a trigger pivot axle.

16. The BB bullet feeding device of a toy gun in accordance with claim 1, wherein the block push member has a lower end pivoted on the trigger by a pivot axle, and an upper end provided with a push portion.

17. The BB bullet feeding device of a toy gun in accordance with claim 16, wherein the locking block is pivoted on the barrel of the gun body by a pivot axle, and located above the block push member, the locking block is provided with a driven portion that may mate with the push portion of the block push member.

18. The BB bullet feeding device of a toy gun in accordance with claim 1, wherein the BB bullet supply portion is mounted on a top of the barrel, and the cocking handle is mounted on a side of the BB bullet supply portion.

* * * * *